US008968844B2

(12) United States Patent
Noguchi et al.

(10) Patent No.: US 8,968,844 B2
(45) Date of Patent: Mar. 3, 2015

(54) RECORDING MEDIUM AND IMAGE RECORDING PROCESS

(71) Applicant: Canon Kabushiki Kaisha, Tokyo (JP)

(72) Inventors: Tetsuro Noguchi, Hachioji (JP); Hisao Kamo, Ushiku (JP); Isamu Oguri, Yokohama (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/926,902

(22) Filed: Jun. 25, 2013

(65) Prior Publication Data

US 2014/0004263 A1 Jan. 2, 2014

(30) Foreign Application Priority Data

Jun. 28, 2012 (JP) ..... 2012-145662

(51) Int. Cl.
*B41M 5/50* (2006.01)
*B41M 5/52* (2006.01)

(52) U.S. Cl.
CPC ..... *B41M 5/502* (2013.01); *B41M 5/52* (2013.01); *B41M 5/508* (2013.01); *B41M 5/5218* (2013.01); *B41M 5/5254* (2013.01)
USPC ..... 428/32.31; 428/32.11; 428/32.32; 428/32.33; 428/32.34

(58) Field of Classification Search
CPC ... B41M 5/502; B41M 5/5218; B41M 5/5254
USPC ..... 428/32.11, 32.31–32.34; 347/106
See application file for complete search history.

(56) References Cited

FOREIGN PATENT DOCUMENTS

| | | | |
|---|---|---|---|
| CN | 102189865 | A | 9/2011 |
| EP | 1839895 | A1 | 10/2007 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2000-355160 | A | 12/2000 |
| JP | 2001-347748 | A | 12/2001 |
| JP | 2002-166643 | A | 6/2002 |
| JP | 2008-302664 | A | 12/2008 |

*Primary Examiner* — Bruce H Hess
(74) *Attorney, Agent, or Firm* — Canon USA, Inc. IP Division

(57) ABSTRACT

A recording medium includes a base and an ink receiving layer. The ink receiving layer contains inorganic particles. The surface of the recording medium has an arithmetic mean roughness of 0.8 μm or more in accordance with JIS B 0601: 2001. The surface of the recording medium includes openings having a width of 30 μm or less and a length of 500 μm or less. The number of the openings is 5 or more and 30 or less per 1 $mm^2$ of the surface of the recording medium.

6 Claims, 1 Drawing Sheet

RECORDING MEDIUM AND IMAGE RECORDING PROCESS

BACKGROUND OF THE INVENTION

1. Field of the Invention

The present invention relates to a recording medium and an image recording process using the recording medium.

2. Description of the Related Art

Recently, recording media having a texture, called luster surface or granular surface, (hereinafter, also referred to as "luster paper") are highly demanded. The luster paper has fine roughness on the surface of the recording medium to appropriately suppress the gloss and to provide a high-grade texture.

Japanese Patent Laid-Open No. 2000-355160 discloses a recording medium having a surface of which arithmetic mean roughness in accordance with Japanese Industrial Standards (JIS) B 0601:2001 is 0.8 to 4.0 μm. Japanese Patent Laid-Open No. 2001-347748 discloses a recording medium having a surface of which arithmetic mean roughness in accordance with JIS B 0601:2001 is 0.4 to 2.5 μm. Both documents describe that the glare due to surface gloss of a recording medium is suppressed by roughening the surface as mentioned above.

A recording medium having a surface provided with purposely formed cracks has also been investigated. Japanese Patent Laid-Open No. 2002-166643 discloses glossy paper having a surface provided with cracks having a thickness of 3 μm or more and 15 μm or less and an area of 250 $\mu m^2$ or more and 2500 $\mu m^2$ or less. In such paper, even when a pigment ink is applied to the paper, the pigment particles penetrate into the cracks and do not remain on the surface of the recording medium, and the gloss of the image is therefore not reduced.

Investigations by the present inventors, however, demonstrate that images recorded on recording media having surface roughness as described in Japanese Patent Laid-Open Nos. 2000-355160 and 2001-347748 have metallic glossiness-like glare or cause bronzing in which reflected light alters the appearance of colors of coloring materials depending on viewing angle of the recorded matter. The recording medium described in Japanese Patent Laid-Open No. 2002-166643 does not have fine roughness on the surface and therefore cannot suppress glossiness and does not provide a luster surface. In addition, since the glossiness is high, bronzing occurs in some cases. Furthermore, since an ink easily penetrates into the recording medium, the resulting image may have an insufficient optical density.

SUMMARY OF THE INVENTION

The present invention provides a recording medium having a luster surface and preventing bronzing of an image formed thereon and allowing the image to have a high optical density. The present invention further provides an image recording process using the recording medium of the invention.

The recording medium according to the present invention includes a base and an ink receiving layer. The ink receiving layer contains inorganic particles. The recording medium has a surface of which arithmetic mean roughness in accordance with JIS B 0601:2001 is 0.8 μm or more. The surface of the recording medium has openings having a width of 30 μm or less and a length of 500 μm or less. The number of the openings is 5 or more and 30 or less per 1 $mm^2$ of the surface of the recording medium.

The recording medium according to the present invention has a luster surface and prevents bronzing of an image formed thereon and allows the image to have a high optical density. Another aspect of the invention is an image recording process using the recording medium.

Further features of the present invention will become apparent from the following description of exemplary embodiments with reference to the attached drawings.

DESCRIPTION OF THE EMBODIMENTS

The present invention will now be described in detail by preferred embodiments. The present inventors have investigated the cause of bronzing that occurs when luster paper is used.

Luster paper is a recording medium having many concave portions on the surface. If an ink is applied to such a recording medium, the ink tends to remain in the concave portions of the recording medium. It is believed that the ink is dried and fixed in such a state to cause localization of the coloring material in the concave portions of the recording medium and thereby to readily cause occurrence of bronzing.

Investigations by the present inventors demonstrate that if the recording medium has a surface of which arithmetic mean roughness in accordance with JIS B 0601:2001 is 0.8 μm or more, a desired luster surface is provided, but bronzing tends to occur by the mechanism described above. Accordingly, various investigations have been done for obtaining luster paper that can sufficiently prevent bronzing even if the arithmetic mean roughness is 0.8 μm or more.

The present inventors have investigated methods of enhancing the ink absorbability of a recording medium by a structure that blocks the mechanism of causing bronzing and prevents inks from remaining in the concave portions on the surface of the recording medium. As a result, the inventors have concluded that it is important that the recording medium has an ink receiving layer containing inorganic particles and that the recording medium has a surface provided with a plurality of openings having a specific size.

Figure 1:
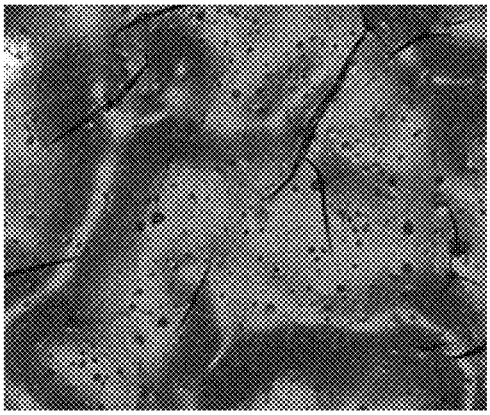
FIG. 1 is a laser-microscopic photograph of the surface of a recording medium of the present invention.

In a recording medium having an ink receiving layer containing inorganic particles, the apertures formed by the inorganic particles in the ink receiving layer absorb the ink applied to the recording medium to prevent the ink from remaining in the concave portions on the surface of the recording medium. Furthermore, since the surface of the recording medium has the openings having a specific size, the ink flows into the ink receiving layer through the openings of the concave portions on the surface of the recording medium to further accelerate the absorption of the ink by the apertures formed by the inorganic particles. It is believed that the ink is prevented from remaining in the concave portions on the surface of the recording medium as described above to prevent bronzing of the image. FIG. 1 shows a photograph of the surface of a recording medium of the present invention observed with a laser microscope VK-9710 (manufactured by Keyence Corporation). The cracks shown in the photograph are the openings in the present invention.

Figure 2A:
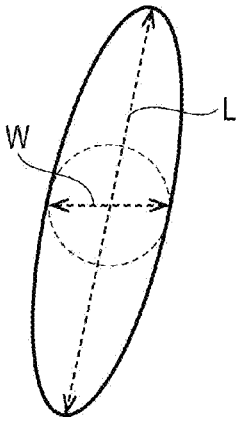
FIGS. 2A to 2C are diagrams illustrating the lengths and the widths of openings in the present invention.
Figure 2B:
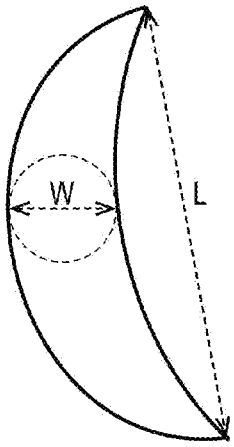
Figure 2C:
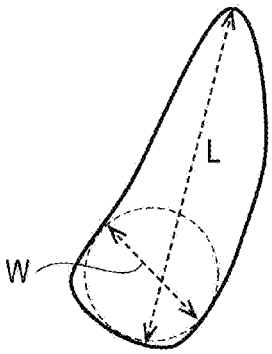

Further investigations by the present inventors have revealed that the openings provided to the surface of the recording medium need to have a width of 30 μm or less and a length of 500 μm or less and that the necessary number of the openings is 5 or more and 30 or less per 1 $mm^2$ of the surface of the recording medium. The number of the opening is preferably 10 or more and 30 or less per 1 $mm^2$ of the surface. In the present invention, the terms "length of an opening" and "width of an opening" are defined as follows. In the present invention, the term "length of an opening" refers to the length of the longest straight line connecting arbitrary two points on the outline of the opening (L in each of FIGS. 2A to 2C). The term "width of an opening" refers to the diameter of the largest circle inscribed to the opening (W in each of FIGS. 2A to 2C).

In the present invention, the widths and the lengths of the openings and the number of the openings per 1 $mm^2$ are derived by observing the surface of the recording medium with an electron microscope. Specifically, a recording medium surface is observed at a magnification of 200 with a laser microscope VK-9710 (manufactured by Keyence Corporation). An arbitrary square region of 1 mm×1 mm is determined in the surface of a recording medium. The widths and the lengths of all openings contained in the region are derived according to the above-described definition, and then the openings having a width of 30 μm or less and a length of 500 μm or less is counted. The opening existing at the boundary of the region of 1 mm×1 mm is counted as being contained in the region. This process is carried out for different ten regions, and average value of the numbers of openings having a width of 30 μm or less and a length of 500 μm or less is calculated as the "number of openings having a width of 30 μm or less and a length of 500 μm or less per 1 $mm^2$ of the surface of a recording medium". In also examples described below, the widths and the lengths of openings and the number of openings per 1 $mm^2$ were determined by the same method.

Though the surface may have openings having a width of larger than 30 μm or openings having a length of larger than 500 μm, such openings increase the ink absorbability to reduce the optical density of an image formed thereon. Accordingly, the number of such openings should be low. In the present invention, the number of openings having a width of larger than 30 μm and openings having a length of larger than 500 μm should be 20% or less to the number of openings having a width of 30 μm or less and a length of 500 μm or less per 1 $mm^2$ of the surface of a recording medium.

If the number of openings having a width of 30 μm or less and a length of 500 μm or less is less than 5 per 1 $mm^2$ of the surface of a recording medium, the effect of preventing bronzing is insufficient.

If the number of openings having a width of 30 μm or less and a length of 500 μm or less is larger than 30 per 1 $mm^2$ of the surface of a recording medium, the openings are visible to the naked eye in some cases, resulting in loss of the high-grade texture as luster paper. In addition, such a surface has high ink absorbability to reduce the optical density of images.

According to the mechanism described above, the effect of the present invention is achieved by synergistic effects of each composition.

In the present invention, whether a recording medium has a luster surface or not is determined by the following method. The surface of a recording medium is irradiated with incident light at an incident angle of 60 degrees from the vertical direction, and L* value ($L^*_1$) of reflection light at a light receiving angle of 60 degrees from the vertical direction and L* value ($L^*_2$) of reflection light at a light receiving angle of 67 degrees were measured with a three-dimensional goniophotometer GCMS-3B (manufactured by Murakami Color Research Laboratory). The ratio of $L^*_2$ to $L^*_1$ ($L^*_2/L^*_1$) was calculated. Investigations by the present inventors demonstrate that the value of $L^*_2/L^*_1$ correlates to the texture of the surface of a recording medium and that a ratio $L^*_2/L^*_1$ of 0.3 or more provides a desired luster surface. Accordingly, in the present invention, a recording medium of which surface has a ratio $L^*_2/L^*_1$ of 0.3 or more is determined to have a luster surface.

Recording Medium

The recording medium of the present invention includes a base and an ink receiving layer. The present invention can be applied to a recording medium that is used in ink jet recording.

The recording medium of the present invention has a surface having an arithmetic mean roughness of 0.8 μm or more in accordance with JIS B 0601:2001. The arithmetic mean roughness of the surface of the recording medium is preferably 2.5 μm or less and more preferably 1.0 μm or more and 2.0 μm or less. The arithmetic mean roughness of the surface of a recording medium can be controlled by, for example, a method pressing a roll having specific asperities to the surface of a base coated with a polyolefin resin and further applying a coating solution for ink receiving layer to the surface or a method pressing a roll having specific asperities to the surface of a recording medium. Each member constituting the recording medium of the present invention will now be described.

Base

The base may be composed of base paper only or may be composed of base paper and a resin layer, i.e., base paper coated with a resin. In the present invention, a base composed of base paper and a resin layer can be used. Such a structure in which a resin coats base paper can decrease penetration of water in an ink into the base and can inhibit cockling. The resin layer may be provided to only one surface of the base paper or may be provided to both surfaces of the base paper, but the surface on the ink receiving layer side of the base should be coated with the resin.

The base paper is produced by papermaking of wood pulp as the main raw material and, optionally, synthetic pulp such as polypropylene and synthetic fibers such as nylon or polyester fibers. Examples of the wood pulp include broadleaf tree bleached kraft pulp (LBKP), broadleaf tree bleached sulfite pulp (LBSP), needle-leaf bleached kraft pulp (NBKP), needle-leaf bleached sulfite pulp (NBSP), broadleaf dissolving pulp (LDP), needle-leaf dissolving pulp (NDP), broadleaf unbleached kraft pulp (LUKP), and needle-leaf unbleached kraft pulp (NUKP). These may be used alone or in combination as necessary. In particular, among these wood pulp, LBKP, NBSP, LBSP, NDP, and LDP, which contain short fiber components in large amounts, can be particularly used. As the pulp, chemical pulp (such as sulfate pulp or sulfite pulp), which contain impurities in less amounts, can be particularly used. In addition, pulp of which brightness is enhanced by bleaching can be used. The base paper may appropriately contain a sizing agent, a white pigment, a paper strengthening agent, a fluorescent brightening agent, a moisture-retaining agent, a dispersant, a softening agent, etc.

The basis weight of the base paper is preferably 50 $g/m^2$ or more and 250 $g/m^2$ or less and more preferably 70 $g/m^2$ or more and 200 $g/m^2$ or less. The base paper can have a thickness of 50 μm or more and 210 μm or less. The base paper may be smoothened by calender treatment in the papermaking stage or after papermaking. The paper density in accordance with JIS P 8118 can be 0.7 $g/cm^3$ or more and 1.2 $g/cm^3$ or less. The base paper stiffness in accordance with JIS P 8143 can be 20 g or more and 200 g or less. The pH in accordance with JIS P 8113 of the base paper can be 5 or more and 9 or less.

In the present invention, in the case of a base having a resin layer, the thickness of the resin layer is preferably 10 μm or more and 40 μm or less and more preferably 20 μm or more and 40 μm or less. If the thickness is not less than 20 μm, necessary asperities for providing various surface qualities can be effectively formed by pressing a roll having asperities to the resin layer. In the present invention, the thickness of the resin layer is calculated by the following method. A recording medium is cut with a microtome, and the resulting cross section is observed with a scanning electron microscope. The thickness of the resin layer is determined as the average of the thicknesses at arbitrary 100 points or more of the resin layer. The thicknesses of other layers in the present invention are calculated by the same method.

The resin layer can be a thermoplastic resin. Examples of the thermoplastic resin include acrylic resins, acrylic silicone resins, polyolefin resins, and styrene-butadiene copolymers. Among these resins, polyolefin resins can be particularly used. In the present invention, the term "polyolefin resin" refers to a polymer prepared using olefin as a monomer. Specific examples thereof include homopolymers and copolymers of, for example, ethylene, propylene, and isobutylene. The polyolefin resins may be used in one type or in a combination of two or more types thereof as necessary. Among these resins, polyethylene can be particularly used. The polyethylene may be low density polyethylene (LDPE) or high density polyethylene (HDPE). The resin layer may contain, for example, a white pigment, a fluorescent brightening agent, or ultramarine for controlling the opacity, brightness, and hue. In particular, since the white pigment can enhance the opacity, the resin layer can contain the white pigment. Examples of the white pigment include rutile-type and anatase-type titanium oxides.

In the present invention, the arithmetic mean roughness in accordance with JIS B 0601:2001 of the base can be 1.2 μm or more and 3.5 μm or less. A base having a large arithmetic mean roughness such as 1.2 μm or more, even if less than 3.5 μm, causes unevenness in the thickness of the ink receiving layer to readily form openings by shrinkage strain.

The shape of the roll to be pressed to the surface of the base coated with a polyolefin resin is appropriately selected depending on, for example, the thickness of the ink receiving layer to be formed such that the surface of the recording medium finally has an arithmetic mean roughness of 0.8 μm or more. Specifically, in the case of an ink receiving layer having a small thickness, since the asperities on the surface of the base coated with a polyolefin resin are readily transferred to the surface of a recording medium, the asperities can be formed by pressing a roll that can provide an arithmetic mean roughness of 0.8 μm or more to the surface of the base coated with the polyolefin resin. In contrast, in the case of an ink receiving layer having a large thickness, since the asperities on the surface of the base coated with a polyolefin resin are hardly transferred to the surface of a recording medium, a roll having larger asperities should be pressed. More specifically, in an ink receiving layer having a thickness of 20 μm or more and 50 μm or less, a roll having an arithmetic mean roughness of 1 μm or more is pressed.

Ink Receiving Layer

In the present invention, the ink receiving layer is formed at least one surface of the base. The ink receiving layer may be formed on both surfaces of the base. In the present invention, the ink receiving layer contains inorganic particles. The details will be described below. The ink receiving layer can be formed by applying a coating solution for ink receiving layer onto a base. The coating amount can be 5 g/m$^2$ or more and 50 g/m$^2$ or less as a dried coating amount. In a coating amount of 5 g/m$^2$ or more, the ink absorbability is high, resulting in a high effect of inhibiting bronzing. In a coating amount of 50 g/m$^2$ or less, drying in formation of the ink receiving layer rapidly proceeds, resulting in high productivity. The materials that can be contained in the ink receiving layer will now be described.

Inorganic Particles

In the present invention, the ink receiving layer contains inorganic particles. The inorganic particles preferably have an average primary particle diameter of 1 nm or more and less than 1 μm, more preferably 30 nm or less, and most preferably 3 nm or more and 10 nm or less. In the present invention, the average primary particle diameter of the inorganic particles is the number-average particle diameter of the diameters of circles having the same areas as projected areas of primary particles of the inorganic particles observed by an electron microscope. On this occasion, the measurement is performed for at least 100 points.

In the present invention, the content (% by mass) of the inorganic particles in the ink receiving layer is preferably 50% by mass or more and 98% by mass or less and more preferably 70% by mass or more and 96% by mass or less.

In the present invention, the amount (g/m$^2$) of the inorganic particles that are applied when the ink receiving layer is formed can be 8 g/m$^2$ or more and 45 g/m$^2$ or less. In this range, the ink receiving layer can have a preferred thickness.

Examples of the inorganic particles used in the present invention include hydrated alumina, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These inorganic particles can be used in one type or in a combination of two or more types thereof, as necessary. Among these inorganic particles, hydrated alumina, alumina, and silica can form porous structures having high ink absorbability and can be particularly used.

The hydrated alumina used in the ink receiving layer can be those represented by Formula (X):

$$Al_2O_{3-n}(OH)_{2n}.mH_2O$$

(wherein, n represents 0, 1, 2, or 3; and m represents 0 or more and 10 or less, preferably 0 or more and 5 or less, provided that m and n do not simultaneously represent 0). In many cases, $mH_2O$ represents a detachable aqueous phase that does not participate in the formation of a crystal lattice. Therefore, m does not necessarily represent an integer. Furthermore, when the hydrated alumina is heated, m can be 0.

In the present invention, the hydrated alumina can be produced by a known method. Specific examples of the method include hydrolysis of an aluminum alkoxide, hydrolysis of sodium aluminate, and neutralization of an aqueous sodium aluminate solution with an aqueous aluminum sulfate or aluminum chloride solution.

It is known that hydrated alumina has crystalline structures of amorphous, gibbsite-type, and boehmite-type, depending on the temperature of heat treatment, and all of these crystalline structures can be used in the present invention. In particular, hydrated alumina showing a boehmite or amorphous structure in X-ray diffraction analysis can be used. Specific examples of the hydrated alumina include those described in Japanese Patent Laid-Open Nos. 7-232473, 8-132731, 9-66664, and 9-76628 and commercially available hydrated alumina such as Disperal HP14 and Disperal HP18 (manufactured by Sasol Limited). These hydrated alumina products can be used alone or in a combination of two or more thereof, as necessary.

Furthermore, in the present invention, the hydrated alumina preferably have a specific surface area of 100 m$^2$/g or more and 200 m$^2$/g or less, more preferably 125 m$^2$/g or more and 175 m$^2$/g or less, determined by a Brunauer-Emmett- Teller (BET) method. The BET method determines the specific surface area of a sample by allowing molecules or ions having known sizes to adsorb to the surface of the sample and measuring the amount of the adsorbed molecules or ions. In the present invention, nitrogen gas is used as the gas that is adsorbed to the sample.

Examples of the alumina used in the ink receiving layer include γ-alumina, α-alumina, δ-alumina, θ-alumina, and χ-alumina. In particular, γ-alumina can be used from the viewpoints of optical density of the image and ink absorbability, and examples thereof include AEROXIDE Alu C (manufactured by EVONIK Industries A.G.).

The hydrated alumina and alumina used in the present invention can be mixed in the coating solution for ink receiving layer as an aqueous dispersion, and an acid can be used as a dispersant therefor. A sulfonic acid represented by Formula (Y):

$$R—SO_3H$$

(wherein, R represents a hydrogen atom, an alkyl group having 1 to 3 carbon atoms, or an alkenyl group having 1 to 3 carbon atoms and is optionally substituted by an oxo group, a halogen atom, an alkoxy group, or an acyl group) has an effect of inhibiting bleeding of images and can be therefore used as the acid.

The silica used in the ink receiving layer is roughly classified based on the production process into wet-method silica and dry-method silica (gas-phase method silica). In the wet method, hydrous silica is produced by generating active silica by acidolysis of silicate and appropriately polymerizing the active silica for coagulation sedimentation. In the dry method (gas-phase method), anhydrous silica is produced by high-temperature gas-phase hydrolysis (flame hydrolysis process) of a silicon halide or by heating, reducing, and vaporizing silica sand and cokes by arc in an electrical furnace and oxidizing the resulting product in air (arc method). In the present invention, in particular, the silica obtained by the dry method (gas-phase method) (hereinafter, also referred to as "gas-phase method silica") can be used. The gas-phase method silica has a particularly large specific surface area and therefore has high ink absorbability, and has a low refractive index and therefore can provide transparency to the ink receiving layer. As a result, satisfactory color developability is achieved. Specific examples of the gas-phase method silica include Aerosil (manufactured by Nippon Aerosil Co., Ltd.) and Reolosil QS type (manufactured by Tokuyama Corporation).

In the present invention, the specific surface area of the gas-phase method silica measured by the BET method is preferably 50 $m^2/g$ or more and 400 $m^2/g$ or less and more preferably 200 $m^2/g$ or more and 350 $m^2/g$ or less.

In the present invention, the gas-phase method silica can be used in a state dispersed with a dispersant in the coating solution for ink receiving layer. The gas-phase method silica in the dispersed state can have a particle diameter of 50 nm or more and 300 nm or less. The particle diameter of the gas-phase method silica in the dispersed state can be measured by dynamic light scattering.

In the present invention, hydrated alumina, alumina, and silica may be used as a mixture. Specifically, at least two selected from hydrated alumina, alumina, and silica are mixed in a powder state and dispersed into a dispersion.

Binder

In the present invention, the ink receiving layer can further contain a binder. In the present invention, the binder is a material that can bind the inorganic particles and can form a coat.

Examples of the binder include starch derivatives such as oxidized starch, esterified starch, and phosphorylated starch; cellulose derivatives such as carboxymethyl cellulose and hydroxyethyl cellulose; casein, gelatin, soybean protein, polyvinyl alcohol (PVA), and derivatives thereof; various polymers such as polyvinylpyrrolidone and maleic anhydride resins and conjugated polymer latex such as styrene-butadiene copolymers and methyl methacrylate-butadiene copolymers; acrylic polymer latex such as polymers of acrylate and methacrylate; vinyl polymer latex such as ethylene-vinyl acetate copolymers; functional group-modified polymer latex of the above-mentioned various polymers with monomers containing functional groups such as carboxyl groups; the above-mentioned polymers cationized with cationic groups; the above-mentioned polymers of which surfaces are cationized with cationic surfactants; the above-mentioned polymers polymerized in the presence of cationic polyvinyl alcohol so as to distribute the polyvinyl alcohol on the polymer surfaces; the above-mentioned polymers polymerized in a suspension/dispersion of cationic colloidal particles so as to distribute the cationic colloidal particles on the polymer surfaces; aqueous binders such as thermosetting synthetic resins, e.g., melamine resins and urea resins; polymer and copolymer resins of methacrylate and acrylate such as polymethyl methacrylate; and synthetic resin binders such as polyurethane resins, unsaturated polyester resins, vinyl chloride-vinyl acetate copolymers, polyvinyl butyral, and alkyd resins. These binders may be used alone or in a combination of two or more thereof, as necessary.

Among the above-mentioned binders, polyvinyl alcohol and polyvinyl alcohol derivatives can be particularly used. Examples of the polyvinyl alcohol derivative include cation-modified polyvinyl alcohol, anion-modified polyvinyl alcohol, silanol-modified polyvinyl alcohol, and polyvinyl acetal.

The polyvinyl alcohol can be synthesized by saponification of polyvinyl acetate. The degree of saponification of the polyvinyl alcohol is preferably 80 mol % or more and 100 mol % or less and more preferably 85 mol % or more and 100 mol % or less. The degree of saponification is the ratio of the molar number of hydroxy groups generated by saponification of polyvinyl acetate to the molar number of polyvinyl alcohol, and is a value measured by a method of JIS-K6726, in the present invention. In addition, the polyvinyl alcohol preferably have an average degree of polymerization of 1500 or more and 5000 or less and more preferably 2000 or more and 5000 or less. Incidentally, the average degree of polymerization in the present invention is the viscosity average degree of polymerization determined by a method of JIS-K6726.

In the preparation of the coating solution for ink receiving layer, the polyvinyl alcohol or its derivative can be used as an aqueous solution thereof. The amount of the solid content of the polyvinyl alcohol or its derivative in the aqueous solution can be 3% by mass or more and 20% by mass or less.

Crosslinking Agent

In the present invention, the ink receiving layer may further contain a crosslinking agent. Examples of the crosslinking agent include aldehyde compounds, melamine compounds, isocyanate compounds, zirconium compounds, amide compounds, aluminum compounds, boric acids, and boric acid salts. These crosslinking agents can be used alone or in a combination of two or more thereof, as necessary. Among the above-mentioned crosslinking agents, boric acids and boric acid salts can be particularly used in the case of using polyvinyl alcohol as the binder.

Examples of the boric acid include orthoboric acid ($H3BO_3$), metaboric acid, and diboric acid. The boric acid salt can be any of water-soluble salts of these boric acids, and examples of the boric acid salt include alkali metal salts of boric acids such as sodium salts and potassium salts of boric acids; alkaline earth metal salts of boric acids such as magnesium salts and calcium salts of boric acids; and ammonium salts of boric acids. Among these boric acids and boric acid salts, orthoboric acid can be particularly used from the viewpoint of stabilizing the coating solution for a long time.

The amount of the crosslinking agent can be appropriately selected depending on, for example, the production conditions. The size and the number of openings on the surface of a recording medium can be controlled by adjusting the amount of the crosslinking agent. The amount of the crosslinking agent can be 0.2 equivalents or more and 1.2 equivalents or less to the amount of the binder in the ink receiving layer. The "1.0 equivalent" is defined as the amount of a crosslinking agent that theoretically entirely reacts with the crosslinking group (hydroxy group in the case of polyvinyl alcohol) possessed by one mole of a binder.

In the case of using polyvinyl alcohol as a binder and at least one crosslinking agent selected from boric acids and boric acid salts, the total amount of the boric acid and the boric acid salt based on the amount of the polyvinyl alcohol in the ink receiving layer can be 2% by mass or more and 7% by mass or less.

Other Additives

In the present invention, the ink receiving layer may contain other materials in addition to the materials described above. Examples of such additives include pH adjusters, thickeners, fluidity modifiers, antifoaming agents, foam inhibitors, surfactants, release agents, penetrants, color pigments, color dyes, fluorescent brightening agents, ultraviolet absorbers, antioxidants, antiseptics, antifungal agents, water resistant additives, dye-fixing agents, hardening agents, and weather resistant materials.

In the present invention, the ink receiving layer can further contain particles (also referred to as "large-diameter particles") having an average particle diameter of 1 μm or more. The large-diameter particles can have an average particle diameter of 2 μm or more and 5 μm or less. In the present invention, the average particle diameter of large-diameter particles is the average secondary particle diameter in the case of using silica particles described below and is the average primary particle diameter in the case of using resin particles described below. The size and the number of openings on the surface of a recording medium can be controlled by adjusting the average particle diameter and the amount of the large-diameter particles contained the ink receiving layer. In the coating solution for ink receiving layer containing large-diameter particles, during application thereof and drying, shrinkage strain occurs, and thereby openings are readily generated using the large-diameter particles for the starting points.

The large-diameter particles preferably have an average particle diameter of 2.0 μm or more and 10.0 μm or less and more preferably 2.0 μm or more and 6.0 μm or less. In the present invention, the average particle diameter of the large-diameter particles can be measured by the same method as that for measuring the average particle diameter of the inorganic particles.

The solid content of the large-diameter particles contained in the ink receiving layer is preferably 0.001 $g/m^2$ or more and 0.05 $g/m^2$ or less and more preferably 0.003 $g/m^2$ or more and 0.02 $g/m^2$ or less.

The large-diameter particles can be at least one type of particles selected from silica particles and resin particles. The silica particles can be silica produced by a wet method (hereinafter, also referred to as "wet-method silica"). Examples of the wet-method silica include precipitation method silica produced by a reaction of sodium silicate with sulfuric acid under a basic condition and sol-gel method silica produced by a reaction of sodium silicate with sulfuric acid under an acidic condition. Examples of the precipitation method silica include NIPSIL K-500 (manufactured by Tosoh Silica Corporation) and FINESIL: X-37, X-37B, and X-45 (manufactured by Tokuyama Corporation). Examples of the sol-gel method silica include MIZUKASIL: P-707 and P78A (manufactured by Mizusawa Industrial Chemicals, Ltd.).

Examples of the resin particle include particles of polyamide resins, polyester resins, polycarbonate resins, polyolefin resins, polystyrene resins, polyvinyl chloride resins, polyvinylidene chloride resins, polyphenylene sulfide resins, ionomer resins, acrylic resins, vinyl resins, urea resins, melamine resins, polyurethane resins, nylon, cellulose compounds, and starch. Among these particles, particles of polyolefin resins, polystyrene resins, acrylic resins, and starch can be particularly used.

In the present invention, the ink receiving layer contains inorganic particles and also contains large-diameter particles, polyvinyl alcohol, and at least one selected from boric acids and boric acid salts. The total amount of boric acids and boric acid salts to the amount of the polyvinyl alcohol in the ink receiving layer can be 2% by mass or more and 7% by mass or less. In such amounts, the number of openings having a width of 30 μm or less and a length of 500 μm or less can be controlled to 5 or more and 30 or less per 1 $mm^2$ of the surface of a recording medium.

Method of Producing Recording Medium

In the present invention, the recording medium may be produced by any method. In particular, the recording medium can be produced by a method including a step of applying a coating solution for ink receiving layer onto a base. A method of producing the recording medium will be described.

Method of Producing Base

In the recording medium of the present invention, the base can be produced by a common process of producing paper. Examples of the papermaking machine include Fourdrinier paper machines, cylinder paper machines, drum paper machines, and twin wire paper machines. The base may be coated with a polyolefin resin by extruding a melted polyolefin resin onto one or both surfaces of the base. A pattern of desired surface roughness can be provided by pressing, for example, a roll having asperities to a base coated with a polyolefin resin on both surfaces thereof. Examples of the method of forming the roughness pattern include a method of performing embossing calender after coating of a resin and a method of cooling the base while pressing a cooling roll having a surface provided with asperities during coating of a resin. The later method can transfer a homogeneous roughness pattern with higher precision with a lower pressure.

As described above, the arithmetic mean roughness of the surface of a recording medium can be controlled to 0.8 μm or more by controlling the arithmetic mean roughness of the surface of the base.

The size and the number of openings on the surface of a recording medium can be controlled by appropriately adjusting the arithmetic mean roughness of the surface of the base. For example, openings can be readily formed on the surface of a recording medium by increasing the arithmetic mean roughness of the surface of the base. Method of forming ink receiving layer The ink receiving layer can be formed on the base of the recording medium of the present invention by, for example, preparing a coating solution for ink receiving layer containing inorganic particles and applying the coating solution onto the base, followed by drying to give the recording medium of the present invention. The application of the coating solution can be performed, for example, using a curtain coater, a coater employing an extrusion system, or a coater employing a slide hopper. The coating solution may be heated when it is applied. Examples of the method of drying after the application include methods using hot air dryers such as a linear tunnel dryer, an arch dryer, an air loop dryer, and a sine-curve air float dryer and methods using infrared rays, heating dryers, and microwaves.

In the present invention, the size and the number of openings on the surface of a recording medium can be controlled during formation of the ink receiving layer, specifically, by controlling the materials contained in the ink receiving layer or controlling the conditions for forming the ink receiving layer. As the former method, for example, the size and the number of openings on the surface of a recording medium can be controlled by controlling the amounts of the binder and the crosslinking agent in the ink receiving layer or by adding the large-diameter particles to the ink receiving layer. As the later method, for example, the size and the number of openings on the surface of a recording medium can be controlled by controlling the solid content in the coating solution for ink receiving layer, controlling the thickness by increasing the application amount of the coating solution for ink receiving layer, or controlling the dry strength after application of the coating solution.

Image Recording Process

The image recording process of the present invention is a process of recording an image by putting an ink onto the recording medium described above. In the present invention, ink jet recording by discharging an ink from a discharge port of a recording head by an ink jetting system can be employed. In particular, ink jet recording by applying thermal energy to an ink to discharge the ink from a discharge port of a recording head can be employed.

Ink

The image recording process of the present invention can use any ink that has been commonly used. The ink of the present invention can be an aqueous ink containing water or an aqueous medium, which is a solvent mixture of water and a water-soluble organic solvent.

The coloring material may be any pigment or dye. In particular, the ink used in the image recording process of the present invention can contain a metal phthalocyanine coloring material. The metal phthalocyanine coloring material tends to cause bronzing, and therefore inhibition of bronzing as one effect of the present invention is highly effective.

Examples of the metal phthalocyanine coloring material include metal phthalocyanine pigments and metal phthalocyanine dyes such as phthalocyanine blue and phthalocyanine green. Examples of the metal phthalocyanine dye include C.I. Direct Blues: 86, 87, 90, 98, 106, 108, 120, 158, 163, 168, 199, 226, and 307; and C.I. Acid Blue: 249.

The content (% by mass) of the metal phthalocyanine dye material in the ink used in the present invention is preferably 1.0% by mass or more and 15.0% by mass or less, more preferably 1.0% by mass or more and 10.0% by mass or less, based on the total mass of the ink.

EXAMPLES

The present invention will now be more specifically described by examples and comparative examples, but is not limited by the following examples, within the scope of the present invention. In the following examples, the term "part(s)" is on a mass basis unless otherwise specified.

Production of Recording Medium

Production of Base

Production of Bases A to F

Twenty parts of light calcium carbonate was added to slurry of 100 parts of broadleaf tree bleached kraft pulp, and 2 parts of cationic starch and 0.3 parts of alkenyl succinic anhydride neutral sizing agent were added thereto, followed by sufficient mixing. The resulting mixture was dried to a moisture content of 10% by mass with a Fourdrinier multi-cylinder paper machine. Onto both surfaces of the resulting paper making raw material, 7% by mass of an oxidized starch solution was applied in an amount of 4 g/m$^2$ with a size press, followed by drying to a water content of 7% by mass to give base paper having a basis weight of 110 g/m$^2$. Onto both surfaces of the resulting base paper, a resin composition composed of 20 parts of high-density polyethylene and 70 parts of low-density polyethylene was applied by melt extrusion in an amount of 30 g/m$^2$. The polyethylene surface of the base paper immediately after the application was subjected to texturing with a cooling roll having asperities on the surface while cooling the base paper to give a base having a basis weight of 170 g/m$^2$. Bases A to F having different arithmetic mean roughness, Ra, values of the base surfaces were prepared by controlling the pressing pressure of the cooling roll and the depth of the asperities of the cooling roll in the texturing. The arithmetic mean roughness of the surface of each base was measured in accordance with JIS B 0601:2001 with a surface roughness meter Surfcorder SE3500 (manufactured by Kosaka Lab.). The results are shown in Table 1.

Production of Base G

A hundred parts of precipitation method silica fine particles Finesil X37 (manufactured by Tokuyama Corporation), 37 parts of polyvinyl alcohol PVA117 (manufactured by Kuraray Co., Ltd.), and 63 parts of SBR latex HITEC E1000 (manufactured by Toho Chemical Industry Co., Ltd.) were dispersed in deionized water to prepare a coating solution having a solid content of 20% by mass. This coating solution was applied onto both surfaces of the base paper prepared above with an air knife coater such that the solid content coated was 15 g/m$^2$, followed by super calender treatment to give a base G having a basis weight of 150 g/m$^2$ and smooth surfaces.

TABLE 1

Type of base and arithmetic mean roughness of the surface

| Base No. | Arithmetic mean roughness of base surface (mm) |
|---|---|
| Base A | 1.2 |
| Base B | 2.3 |
| Base C | 2.9 |
| Base D | 3.4 |
| Base E | 4.0 |
| Base F | 0.1 |
| Base G | 0.3 |

Preparation of Coating Solution for Ink Receiving Layer

Preparation of Coating Solution 1 for Ink Receiving Layer

Hydrated alumina Disperal HP14 (manufactured by Sasol Limited) was added to deionized water in an amount of 20% by mass. Subsequently, methanesulfonic acid was added thereto in an amount of 1.5 parts, in terms of solid content, based on 100 parts of the hydrated alumina solid content. After mixing, the mixture was appropriately diluted with deionized water to give a colloidal sol containing 27% by mass of hydrated alumina. The average particle diameter of the hydrated alumina contained in the resulting colloidal sol measured by a zeta-potential & particle size analyzer ELS Z-2 (manufactured by Otsuka Electronics Co., Ltd.) was 144 nm.

Separately, polyvinyl alcohol PVA235 (manufactured by Kuraray Co., Ltd., viscosity average degree of polymerization: 3500, degree of saponification: 88 mol %) was dissolved in deionized water to give a binder solution having a solid content of 8.0% by mass. The binder solution was mixed with the colloidal sol prepared above such that the polyvinyl alcohol solid content was 10 parts based on 100 parts of the hydrated alumina solid content.

Precipitation method silica fine particles Finesil X37 (manufactured by Tokuyama Corporation) having an average particle diameter of 2.6 μm was added to the resulting mixture in an amount of 1 part based on 100 parts of the hydrated alumina solid content. Furthermore, an aqueous solution of 3.0% by mass of boric acid was added to the resulting mixture such that the solid content of boric acid was 20 parts based on the 100 parts of the polyvinyl alcohol solid content to give a coating solution 1 for ink receiving layer.

Preparation of Coating Solutions 2 to 5 for Ink Receiving Layer

Coating Solutions 2 to 5 for Ink Receiving Layer were prepared as in the preparation of coating solution 1 for ink receiving layer except that an aqueous solution of 3.0% by mass of boric acid was added such that the solid content of the boric acid was 12 parts, 7 parts, 2 parts, or 1 part based on 100 parts of polyvinyl alcohol solid content. Preparation of coating solution 6 for ink receiving layer Coating solution 6 for ink receiving layer was prepared as in the preparation of coating solution 1 for ink receiving layer except that the precipitation method silica fine particles Finesil X37 (manufactured by Tokuyama Corporation) was not added to the solution.

Production of Recording Medium

Recording media were produced in combinations of bases and coating solutions for ink receiving layer shown in Table 2 by applying the coating solutions for ink receiving layer onto the respective bases at a dried amount of 35 g/m$^2$ and performing hot-air drying at a temperature of 100° C. and a wind speed of 10 m/sec. The arithmetic mean roughness of the surface of each recording medium was measured in accordance with JIS B 0601:2001 with a surface roughness meter Surfcorder SE3500 (manufactured by Kosaka Lab.). The "number of openings having a width of 30 μm or less and a length of 500 μm or less per 1 mm$^2$ of the surface of a recording medium" were derived by the method described above for each of the resulting recording media. A recording medium of which arithmetic mean roughness could not be measured because of severely roughened surface is stated as "NO".

TABLE 2

Conditions for producing recording medium and surface characteristics

| Recording medium No. | Base No. | Coating solution No. for ink receiving layer | Arithmetic mean roughness of recording medium surface (μm) | Number of openings having a width of 30 μm or less and a length of 500 μm or less |
|---|---|---|---|---|
| Recording medium 1 | Base A | Coating solution 1 | 0.9 | 2 |
| Recording medium 2 | Base A | Coating solution 2 | 0.8 | 5 |
| Recording medium 3 | Base A | Coating solution 3 | 1.1 | 8 |
| Recording medium 4 | Base A | Coating solution 4 | 0.9 | 25 |
| Recording medium 5 | Base A | Coating solution 5 | 1.2 | 45 |
| Recording medium 6 | Base A | Coating solution 6 | 1.0 | 0 |
| Recording medium 7 | Base B | Coating solution 1 | 1.4 | 2 |
| Recording medium 8 | Base B | Coating solution 2 | 1.7 | 5 |
| Recording medium 9 | Base B | Coating solution 3 | 1.5 | 15 |
| Recording medium 10 | Base B | Coating solution 4 | 1.6 | 18 |
| Recording medium 11 | Base B | Coating solution 5 | 1.4 | NO |
| Recording medium 12 | Base B | Coating solution 6 | 1.6 | 0 |
| Recording medium 13 | Base C | Coating solution 1 | 2.1 | 6 |
| Recording medium 14 | Base C | Coating solution 2 | 2.0 | 8 |
| Recording medium 15 | Base C | Coating solution 3 | 1.9 | 16 |
| Recording medium 16 | Base C | Coating solution 4 | 2.0 | 28 |
| Recording medium 17 | Base C | Coating solution 5 | 2.1 | NO |
| Recording medium 18 | Base C | Coating solution 6 | 2.2 | 0 |
| Recording medium 19 | Base D | Coating solution 1 | 2.5 | 9 |
| Recording medium 20 | Base D | Coating solution 2 | 2.4 | 16 |
| Recording medium 21 | Base D | Coating solution 3 | 2.2 | 17 |
| Recording medium 22 | Base D | Coating solution 4 | 2.4 | 21 |
| Recording medium 23 | Base D | Coating solution 5 | 2.3 | NO |
| Recording medium 24 | Base D | Coating solution 6 | 2.5 | 2 |
| Recording medium 25 | Base E | Coating solution 1 | 3.0 | 13 |
| Recording medium 26 | Base E | Coating solution 2 | 3.1 | 19 |
| Recording medium 27 | Base E | Coating solution 3 | 3.1 | NO |
| Recording medium 28 | Base E | Coating solution 4 | 3.3 | NO |
| Recording medium 29 | Base E | Coating solution 5 | 3.2 | NO |
| Recording medium 30 | Base E | Coating solution 6 | 2.5 | 3 |
| Recording medium 31 | Base F | Coating solution 1 | 0.1 | 0 |
| Recording medium 32 | Base G | Coating solution 1 | 0.3 | 0 |

Evaluation

In the present invention, A and B in the evaluation criteria of each evaluation item are acceptable levels, and C is an unacceptable level. Each evaluation was performed using an ink-jet recording apparatus, PIXUS MP990 (manufactured by CANON KABUSHIKI KAISHA) equipped with an ink cartridge BCI-321 (manufactured by CANON KABUSHIKI KAISHA). The recording conditions were a temperature of 23° C. and a relative humidity of 50%. In the ink-jet recording apparatus, an image recorded under conditions of a resolution of 600×600 dpi and application of one ink drop of about 11 ng to a unit region of 1/600×1/600 inch is defined as a recording duty of 100%.

Evaluation of Texture of Surface of Recording Medium (Evaluation of Whether The Recording Medium has a Luster Surface or Note)

The resulting recording media were subjected to measurement of $L^*_1$ and $L^*_2$ by the above-mentioned method to calculate the ratio $L^*_2/L^*_1$. A recording medium showing a ratio $L^*_2/L^*_1$ of 0.3 or more, i.e., having a luster surface was evaluated as "A", and a recording medium showing a ratio $L^*_2/L^*_1$ of less than 0.3, i.e., not having a luster surface was evaluated as "C". The results are shown in Table 3.

mentioned ink-jet recording apparatus at the photographic paper/glossy gold mode (without color correction). The optical density of each image was measured with a reflection densitometer 530 spectral densitometer (manufactured by X-Rite Inc.) for evaluation. The evaluation criteria are as follows:

A: the optical density was 2.2 or more,

B: the optical density was 2.0 or more and less than 2.2, and

C: the optical density was less than 2.0.

The evaluation results are shown in Table 3.

TABLE 3

| Evaluation results | | | | |
|---|---|---|---|---|
| | | Evaluation results | | |
| Example No. | Recording medium No. | Evaluation of texture of recording medium surface | Evaluation of bronzing in image formation | Evaluation of optical density of formed image |
| Example 1 | Recording medium 2 | A | B | B |
| Example 2 | Recording medium 3 | A | A | A |
| Example 3 | Recording medium 4 | A | A | B |
| Example 4 | Recording medium 8 | A | B | B |
| Example 5 | Recording medium 9 | A | A | A |
| Example 6 | Recording medium 10 | A | A | A |
| Example 7 | Recording medium 13 | A | B | B |
| Example 8 | Recording medium 14 | A | A | A |
| Example 9 | Recording medium 15 | A | A | A |
| Example 10 | Recording medium 16 | A | A | A |
| Example 11 | Recording medium 19 | A | A | A |
| Example 12 | Recording medium 20 | A | A | A |
| Example 13 | Recording medium 21 | A | A | A |
| Example 14 | Recording medium 22 | A | A | A |
| Example 15 | Recording medium 25 | A | A | B |
| Example 16 | Recording medium 26 | A | A | B |
| Comparative Example 1 | Recording medium 1 | A | C | C |
| Comparative Example 2 | Recording medium 5 | A | A | C |
| Comparative Example 3 | Recording medium 6 | A | C | C |
| Comparative Example 4 | Recording medium 7 | A | C | C |
| Comparative Example 5 | Recording medium 11 | A | A | C |
| Comparative Example 6 | Recording medium 12 | A | C | C |
| Comparative Example 7 | Recording medium 17 | A | A | C |
| Comparative Example 8 | Recording medium 18 | A | C | C |
| Comparative Example 9 | Recording medium 23 | A | A | C |
| Comparative Example 10 | Recording medium 24 | A | C | C |
| Comparative Example 11 | Recording medium 27 | A | A | C |
| Comparative Example 12 | Recording medium 28 | A | A | C |
| Comparative Example 13 | Recording medium 29 | A | A | C |
| Comparative Example 14 | Recording medium 30 | A | C | C |
| Comparative Example 15 | Recording medium 31 | C | A | A |
| Comparative Example 16 | Recording medium 32 | C | A | A |

Evaluation of Bronzing in Image Formation

The resulting recording media were stored under conditions at a temperature of 30° C. and a relative humidity of 80% for 6 hours, and then cyan and black solid images (recording duty: 100%) were recorded thereon with the above-mentioned ink-jet recording apparatus at the Canon photographic paper/glossy gold mode (without color correction). The resulting cyan solid images and black solid images were evaluated by visually investigating occurrence of bronzing. The evaluation criteria are as follows:

A: No bronzing occurred in each image,

B: Bronzing occurred in any of the images, and

C: Bronzing occurred in each image.

The evaluation results are shown in Table 3.

Evaluation of Optical Density of Formed Image

A black solid image (recording duty: 100%) was recorded on each of the resulting recording media with the above- Evaluation of Cockling A blue solid image (recording duty: 200%) of 10×10 cm was recorded on each of recording media 19, 31, and 32, and the states of wrinkles of the resulting images were visually investigated for evaluation of cockling. As a result, cockling occurred in recording medium 32 compared to that in recording media 19 and 31.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-145662 filed Jun. 28, 2012, which is hereby incorporated by reference herein in its entirety.

What is claimed is:

1. A recording medium comprising:

a base; and an ink receiving layer, wherein the ink receiving layer contains inorganic particles;

the recording medium has a surface having an arithmetic mean roughness of 0.8 μm or more in accordance with Japanese Industrial Standards (JIS) B 0601:2001;

the surface of the recording medium includes openings having a width of 30 μm or less and a length of 500 μm or less; and the number of the openings is 5 or more and 30 or less per 1 $mm^2$ of the surface of the recording medium.

2. The recording medium according to claim 1, wherein the surface of the recording medium has an arithmetic mean roughness of 2.5 μm or less in accordance with JIS B 0601:2001.

3. The recording medium according to claim 1, wherein the surface on the ink receiving layer side of the base is coated with a polyolefin resin.

4. The recording medium according to claim 1, wherein the base has an arithmetic mean roughness of 1.2 μm or more and 3.5 μm or less in accordance with JIS B 0601:2001.

5. The recording medium according to claim 1, wherein the ink receiving layer further contains particles having an average particle diameter of 1 μm or more, polyvinyl alcohol, and at least one selected from boric acids and boric acid salts; and the total amount of the boric acids and the boric acid salts to the amount of the polyvinyl alcohol in the ink receiving layer is 2% by mass or more and 7% by mass or less.

6. An image recording process comprising applying an ink containing a metal phthalocyanine coloring material to a recording medium, wherein the recording medium is the recording medium according to claim 1.

* * * * *